US005639257A

United States Patent [19]

Yamaguchi et al.

[11] Patent Number: 5,639,257

[45] Date of Patent: Jun. 17, 1997

[54] BOLT-EQUIPPED CONNECTOR

[75] Inventors: Shinji Yamaguchi; Katsuji Shimazawa, both of Tokyo; Hiroshi Takeda, Yokohama, all of Japan

[73] Assignee: Mitsubishi Cable Industies Ltd., Amagasaki, Japan

[21] Appl. No.: 588,885

[22] Filed: Jan. 19, 1996

[30] Foreign Application Priority Data

Jan. 20, 1995 [JP] Japan ..... 7-026201
Jan. 20, 1995 [JP] Japan ..... 7-026202

[51] Int. Cl.[6] ..... H01R 13/627

[52] U.S. Cl. ..... 439/364; 439/359

[58] Field of Search ..... 439/362, 364, 439/350, 352, 353, 357, 358, 359, 595, 701; 411/366–369, 424, 542, 544

[56] References Cited

U.S. PATENT DOCUMENTS 3,853,381 12/1974 Morningstar ..... 439/364
4,645,282 2/1987 Frear ..... 439/364
5,201,625 4/1993 Takenouchi et al. ..... 439/364
5,486,122 1/1996 Oda et al. ..... 439/364

*Primary Examiner*—Hien Vu
*Attorney, Agent, or Firm*—Varndell Legal Group

[57] ABSTRACT

The invention provides a bolt-equipped connector in which the bolt will be mounted when the connector is mated with a counter connector. Engaging protrusions (25*a*, 26*a*) of a bolt holder (20) are engaged with engaging portions (15*b*, 16*b*), whereby the bolt holder (20) is fitted to a holder mounting hole (13) of a housing (11) of a male connector (10). In this state, the bolt (40) is pushed into the bolt holder (20) at the time of mating with a female connector. Engaging pieces (44*b*, 44*c*) of a stop ring (44) additionally provided to the bolt (40) are engaged with a step portion (22*b*) of the bolt holder (20), so that the bolt (40) is rotatably held to the housing (11) via the bolt holder (20). Then, a male screw portion (41) of the bolt (40) is screwed in a screw hole of the female connector, whereby the connectors are mated with each other.

6 Claims, 5 Drawing Sheets

BOLT-EQUIPPED CONNECTOR

BACKGROUND OF THE INVENTION

1. Field of the Invention

The present invention relates to a bolt-equipped connector which allows connectors for use in wire harnesses or the like to be mated with and demated from each other by means of bolts.

2. Description of the Prior Art

Conventionally, male connectors and female connectors have been widely used in, for example, wire harnesses to be used for electrical wiring in automobiles and the like. When extremely large numbers of connecting terminals are used, the mating and demating between these male connector and female connector could hardly be attained only by manual force. Therefore, the mating and demating connectors is often carried out by a bolt being screwed in and out.

For example, as shown in FIG. 1, which is a sectional view of a prior art example, a connector body 1 of a male connector has a bolt holder 2 provided protrudingly and integrally. Into this bolt holder 2, a bolt 3 having a head 3*a* is rotatably inserted. A ring 4 is fitted to the bolt 3 inserted in the bolt holder 2, so that the bolt 3 is restricted in its axial movement relative to the connector body 1 by the ring 4.

The male connector, in which the connector body 1 is normally equipped with the bolt 3 as described above, is fitted into a fitting hole 6 bored in a connector body 5 of a female connector. Then, a male screw portion 3*b* of the bolt 3 is screwed to a female screw portion 7*a* of a nut 7 fixed to the connector body 5. Finally, the connector body 1 and the connector body 5 are moved in the mating direction by turning the bolt 3 clockwise, and moved in the demating direction by turning the bolt 3 counterclockwise. It is noted that connecting terminals built in the male and female connectors are omitted in the drawings.

In the aforementioned connector body 1 to be mated by means of the bolt 3, rubber-make grommets are often used as a protective tube for wire harnesses. This type of grommet is fabricated in such a fashion that its cross-sectional shape will be maintained even under bends, and the grommet is more often used with one end portion coupled with the connector body 1.

For example, as shown in a partly cut-out plan view of FIG. 2, a grommet 8 has an unshown wire harness led thereto in a direction perpendicularly to the bolt 3, or a rearward direction of the drawing sheet. A fit portion 8*a* of the grommet 8 is fitted to the outer periphery of the connector body 1, and an engaging protrusion 1*b* of the connector body 1 is engaged with an engaging recess 8*b* of the grommet 8, whereby the grommet 8 and the connector body 1 are prevented from being demated from each other. Further, in some cases, the outer periphery of the fit portion 8*a* of the grommet 8 may be wound and tightened with a fastening device 9 such as tape or band, so that the grommet 8 and the connector body 1 can be prevented from being demated from each other with more reliability.

However, in the above-described prior art example as shown in FIG. 1, the bolt holder 2 is provided protrudingly and integrally at an end face of the connector body 1, and besides the bolt 3 is normally provided to the bolt holder 2 even prior to use of the bolt 3. This may make causes of some troubles that the wire harness is damaged by the head 3*a* of the bolt 3 during packaging, transferring, and other processes with the wire harness, that the work during the insertion of connecting terminals into the connector body 1 becomes difficult to automatize, and that the car body is flawed during the assembly of the wire harness.

Also, in the prior art example as shown in FIG. 2, it is troublesome work to wind and tighten the fit portion 8*a* of the grommet 8 at its outer periphery with the fastening device 9 for the purpose of preventing the grommet 8 and the connector body 1 from being demated from each other. Moreover, when the grommet 8 is successively bent or compressed, the fit portion 8*a* of the grommet 8 may be expanded wider by internal pressure of the grommet 8, such that the grommet 8 and the connector body 1 would be demated from each other.

SUMMARY OF THE INVENTION

A first object of the present invention is to provide a bolt-equipped connector which, with a view to solving the above-described disadvantages, allows the bolt to be separated off before the mating of the connector with the counter connector and which is therefore convenient to transport and store.

A second object of the present invention is to provide a bolt-equipped connector which allows the grommet equipped for protection of wire harnesses to be retained with reliability.

DETAILED DESCRIPTION OF THE PREFERRED EMBODIMENTS

The present invention is now described in more detail based on an embodiment thereof illustrated in FIGS. 3 through 7.

Figure 1:
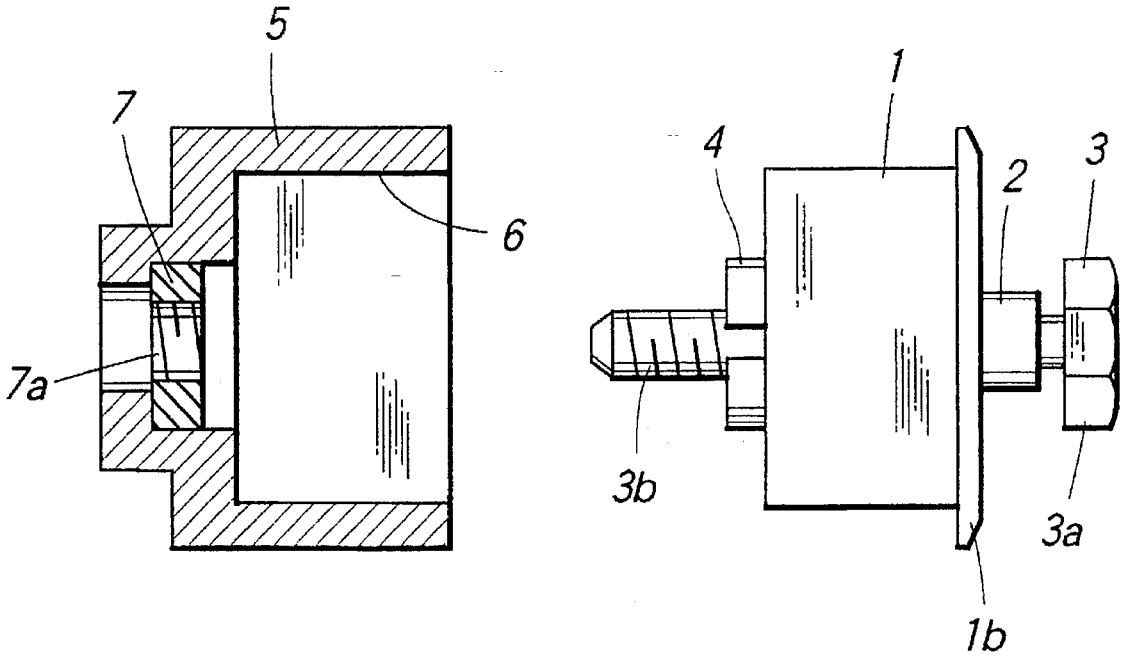
FIG. 1 is an exploded side view of a male connector and a female connector of a prior art example.
Figure 2:
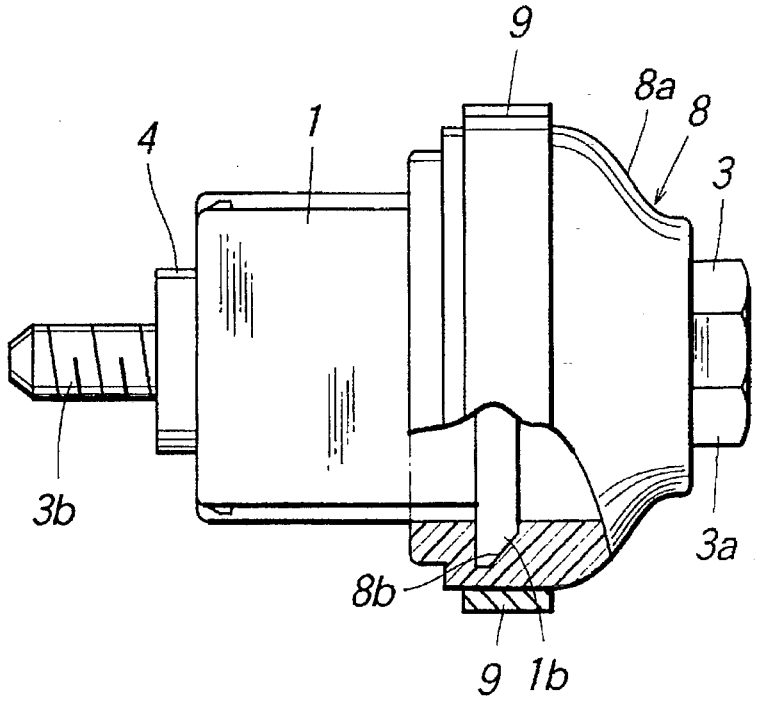
FIG. 2 is a partly sectional view in which a grommet is mounted to the male connector of the prior art example.
Figure 3:
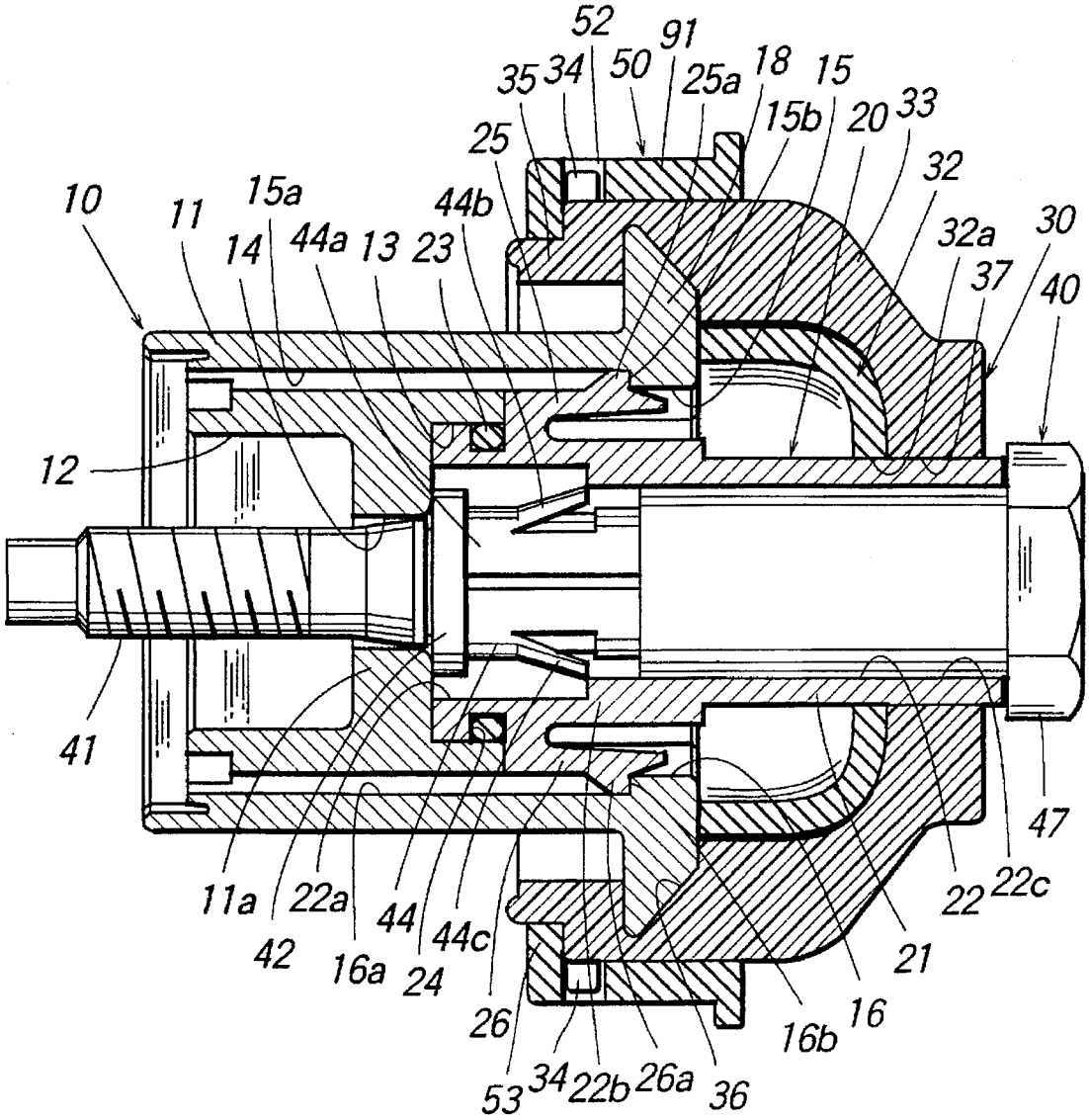
FIG. 3 is an assembly sectional view of an embodiment of the present invention.
Figure 4:
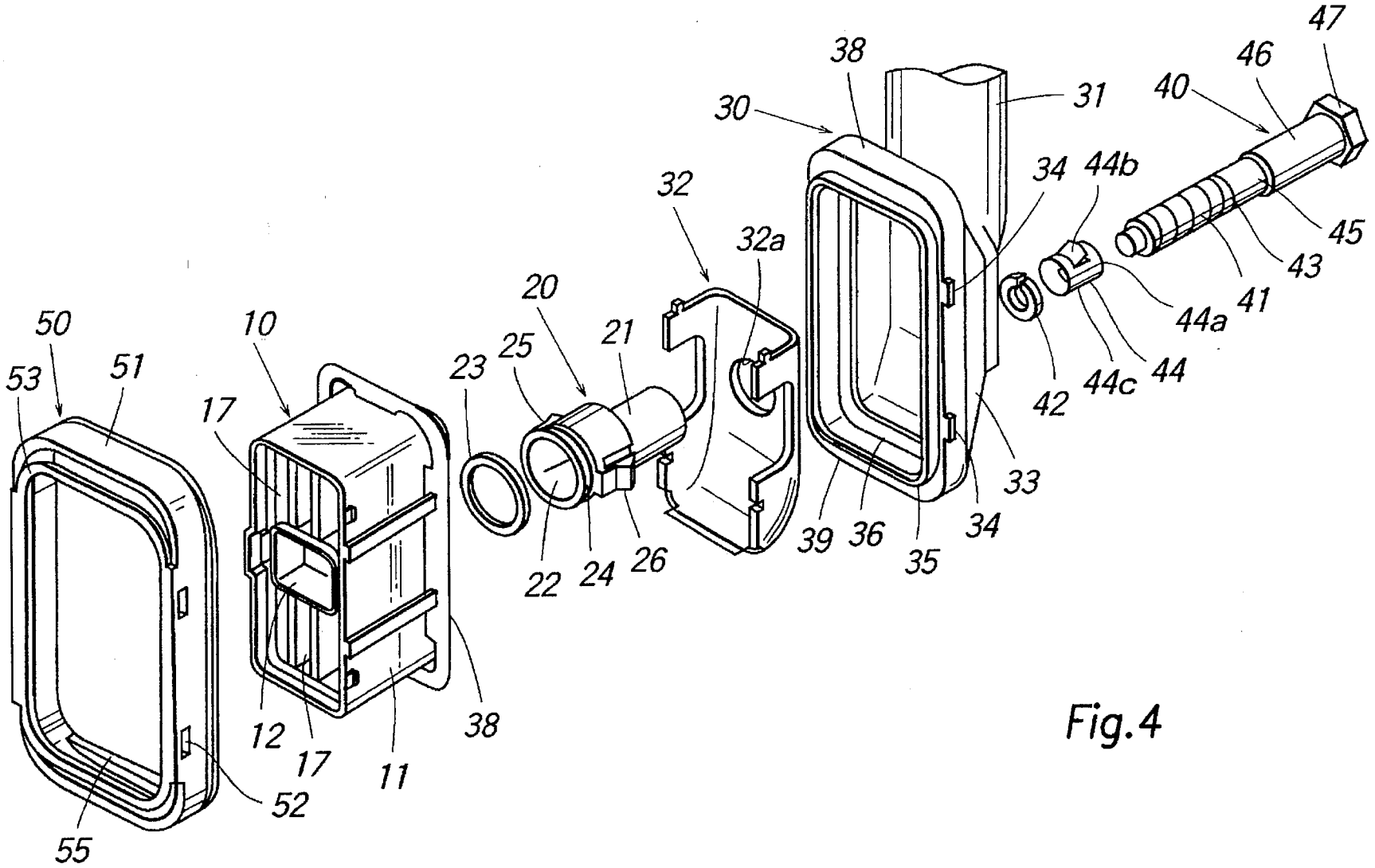
FIG. 4 is an exploded perspective view of the embodiment with a 90° turn about the axis of FIG. 3.

FIG. 3 is an assembly sectional view of the embodiment, and FIG. 4 is an exploded perspective view of the embodiment rotated 90° about the axis of FIG. 3 and exploded. A bolt holder 20 as well as a grommet 30 are installed in the rear of a housing 11 of a male connector 10. A bolt 40 is inserted in the bolt holder 20, and a grommet holder 50 is mounted on the grommet 30.

The housing 11 of the male connector 10, which is intended to accommodate connecting terminals connected to an unshown wire harness, is formed into a rectangular columnar shape from a synthetic resin material having insulating property. A fitting hole 12 for fitting a fitting protrusion of a female connector, which will be described later, and a holder mounting hole 13 for mounting the bolt holder 20 are provided inside the housing 11 with a bulkhead 11*a* interposed there between. The bulkhead 11*a* has a bolt insertion hole 14 for inserting the bolt 40 therein. Guide recesses 15, 16 are provided in both upper and lower walls of the holder mounting hole 13 as shown in FIG. 3. These guide recesses 15, 16 are provided with engaging recesses 15*a*, 16*a* into which later-described engaging protrusions of the bolt holder 20 are to be fitted, and rear walls of the engaging recesses 15*a*, 16*a* serve as engaging portions 15*b*, 16*b* for engaging the bolt holder 20.

Around the fitting hole 12, the holder mounting hole 13, and the bolt insertion hole 14 formed in this way, there are provided a plurality of terminal holes 17 for accommodating the connecting terminals. Further, a flange portion 18 for engaging the grommet 30 is formed on the outer periphery of the housing 11.

The bolt holder 20 formed from a synthetic resin material, and located inside the male connector 10 to hold the bolt 40 The interior of a cylindrical holder body 21 serves as a bolt mounting hole 22 for mounting the bolt 40, and the bolt mounting hole 22 comprises a larger-diameter portion 22*a*, a step portion 22*b*, and a smaller-diameter portion 22*c*.

Front part of the holder body 21 has such an outside diameter as to be fitted to the holder mounting hole 13, where an annular recess 24 for fitting an O-ring 23 and flexible arms 25, 26 for engagement with the male connector 10 are provided on the outer periphery. To these flexible arms 25, 26, engaging protrusions 25*a*, 26*a* to be fitted to the engaging recesses 15*a*, 16*a* of the male connector 10 and thereby engaged with the engaging portions 15*b*, 16*b* are provided so as to be protruded outward.

The grommet 30, made of rubber, is designed to cover a wire harness for the protection of the wire harness. A fit portion 33 for fitting the housing 11 and a wire cover 32 is provided at an end portion of a tubular portion 31 for inserting the wire harness there through. The wire cover 32 is made from a synthetic resin, and serves for protection of the wire harness connected to connecting terminals, where a bolt insertion hole 32*a* for inserting the bolt 40 there through is formed.

The fit portion 33 is formed into, for example, a rectangular frame shape corresponding to the outer shape of the housing 11. In the fit portion 33, a plurality of engaging protrusions 34 for engaging the grommet holder 50 are provided on right and left outer peripheral surfaces of the front part as shown in FIG. 4. Also in the fit portion 33, a thin wall portion 35 with a smaller outside diameter is provided at the front end, an engaging recess 36 for engaging the flange portion 18 of the housing 11 is formed on the inner peripheral surface, and a bolt insertion hole 37 is bored at a deep portion. Further, engaging protrusions 38, 39 for engaging later-described engaging protrusive pieces of the grommet holder 50 are provided at the front end of the fit portion 33, above and below as shown in FIG. 4.

In the metallic bolt 40, there are provided in order a male screw portion 41 to be screwed to the female connector, an annular recess 43 for fitting a washer 42, a smaller-diameter shaft portion 45 for fitting a stop ring 44, a larger-diameter shaft portion 46 to be fitted to the bolt mounting hole 22 of the bolt holder 20, and a head 47 having a diameter larger than the inside diameter of the bolt holder 20. The stop ring 44 is made of metal, and a cylindrical ring body 44*a* of the stop ring 44 has engaging pieces 44*b*, 44*c* formed with their free ends directed obliquely rearward.

The grommet holder 50 serves for securely coupling the grommet 30 with the housing 11 when fitted to the fit portion 33 of the grommet 30, and is made of synthetic resin material. A frame-shaped grommet holder body 51 of the grommet holder 50 has engaging holes 52 to which the engaging protrusions 34 of the grommet 30 are to be fitted, and a smaller-diameter frame portion 53 to make contact with the thin wall portion 35 of the grommet 30 is provided at an end portion of the grommet holder body 51. Further, engaging protrusive pieces 54, 55 (54 not shown) to be engaged with engaging protrusions 38, 39 of the grommet 30 are provided on the inner peripheral surface of front part of the grommet holder body 51, above and below as shown in FIG. 4.

Figure 5:
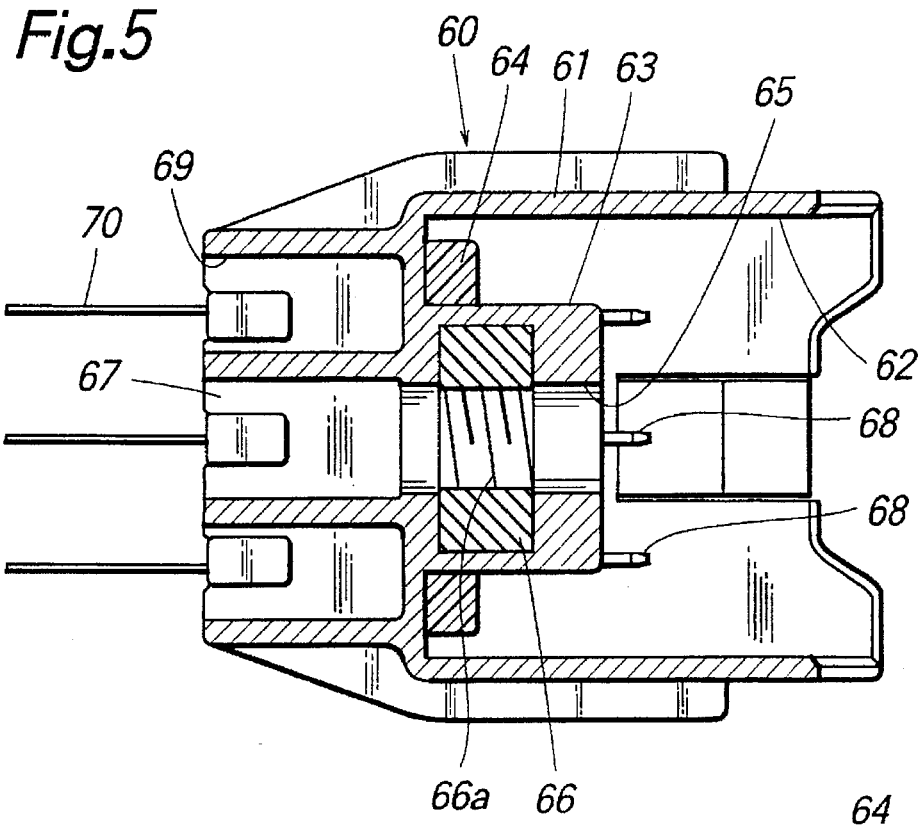
FIG. 5 is an assembly sectional view of a female connector.
Figure 6:
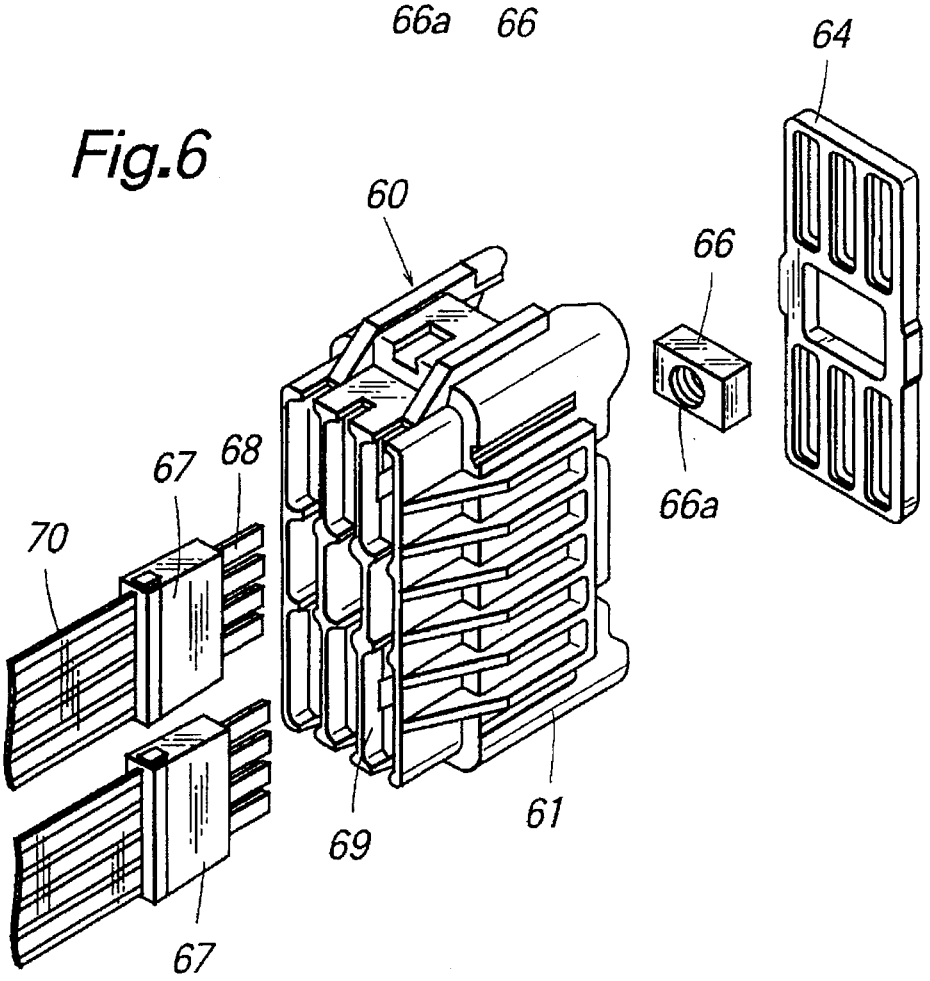
FIG. 6 is an exploded perspective view of the female connector with a 90° turn about the axis of FIG. 5.

Meanwhile, a female connector 60 as shown in the assembly sectional view of FIG. 5 and the exploded perspective view of FIG. 6, which is a 90° turn of FIG. 5 about its axis, is mated with the male connector 10 constructed as described above. A housing 61 of the female connector 60 is formed from a synthetic resin material, and an fitting hole 62 for fitting the housing 11 of the male connector 10 is provided in the front of the housing 61. A fitting protrusion 63 to be fitted to the fitting hole 12 of the male connector 10 is provided at a depth of the fitting hole 62, and a seal member 64 is fitted to the outer periphery of the fitting protrusion 63.

A bolt insertion hole 65 for inserting the male screw portion 41 of the bolt 40 there through is provided inside the fitting protrusion 63, and a metallic nut 66 having a female screw portion 66*a* for screwing the male screw portion 41 of the bolt 40 is insertion-molded on the peripheral wall of the bolt insertion hole 65. Further, a plurality of terminal chambers 69 for accommodating a plurality of connecting terminals 68 held by a terminal holder 67 are provided in the rear of the housing 61. It is noted that numeral 70 denote flexible flat cables which are to be connected to connecting terminals so as to form part of the wire harness.

Figure 7:
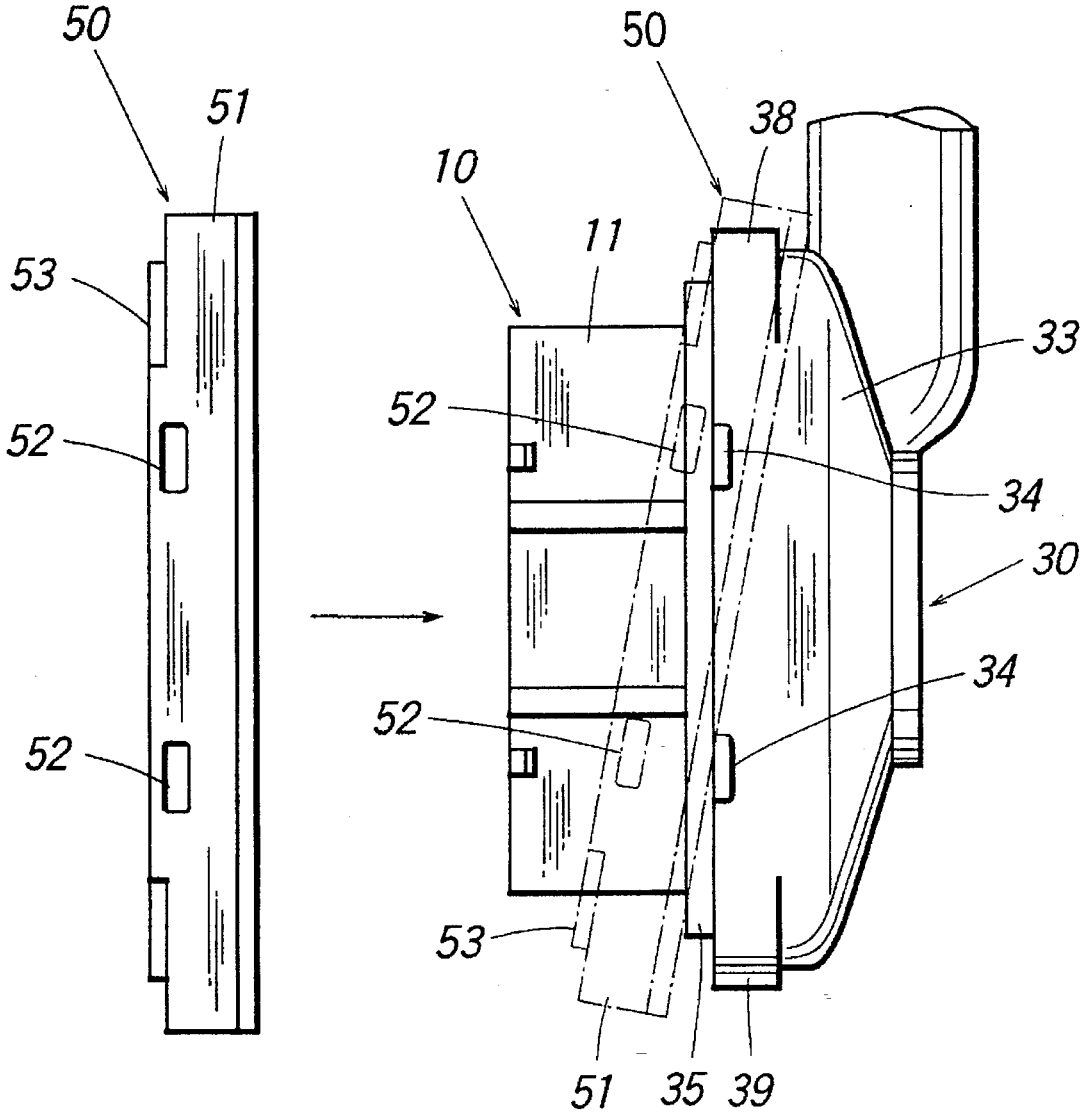
FIG. 7 is a function explanatory view for mounting the grommet holder.

When the male connector 10 and the female connector 60 constructed in the above fashion are mated with each other by the bolt 40, the following steps are taken:

(1) Connecting terminals with the wire harness inserted through the tubular portion 31 and fit portion 33 of the grommet 30 are inserted into the terminal holes 17 of the housing 11. In this process, the connecting terminals may be inserted into the terminal holes 17 by an automatic machine;

(2) The O-ring 23 is fitted to the annular recess 24 of the bolt holder 20. Also, the stop ring 44 is fitted into the smaller-diameter shaft portion 45 of the bolt 40, and the washer 42 is fitted to the annular recess 43. By this process, a sub-assembly of the bolt holder 20 and the bolt 40 is completed. It is noted that the sub-assembly of the bolt 40 may be completed by any arbitrary step;

(3) The bolt holder 20, to which the O-ring 23 has been fitted, is pushed into the holder mounting hole 13 by fitting its flexible arms 25, 26 to the guide recesses 15, 16. In this process, the flexible arms 25, 26 are advanced while being pressed and flexed by low walls of the guide recesses 15, 16, whereby the engaging protrusions 25*a*, 26*a* are fitted into the engaging recesses 15*a*, 16*a* so as to be engaged with the engaging portions 15*b*, 16*b*. Thus, the bolt holder 20 is completely mounted to the housing 11;

(4) The bolt holder 20 is inserted into the insertion hole 32*a* of the wire cover 32, whereby the wire cover 32 is mounted to the bolt holder 20;

(5) While the bolt holder 20 is inserted through the bolt insertion hole 32*a* of the wire cover 32 and the bolt insertion hole 37 of the grommet 30, the grommet 30 is fitted to the housing 11. By this process, the flange portion 18 is engaged with the engaging recess 36 of the grommet 30;

(6) As shown in FIG. 7, by tilting the grommet holder 50 as indicated by dotted lines, the grommet holder body 51 is externally fitted to the fit portion 33 of the grommet 30, and the engaging protrusive piece 54 of the upper part of the grommet holder 50 is engaged with the engaging protrusion 38 of the upper part of the grommet 30. Further, the engaging protrusive piece 55 of the lower part of the grommet holder 50 is engaged with the engaging protrusion 39 of the lower part of the grommet 30, and the engaging protrusions 34 on the right and left of the grommet 30 are fitted into the engaging holes 52 of the grommet holder 50. At this point, the thin wall portion 35 is protruded from the smaller-diameter frame portion 53 of the grommet holder 50.

Thus, an assembly of the male connector 10 made up from the wire harness, housing 11, bolt holder 20, grommet 30, wire cover 32, and grommet holder 50 is completed. Then, the assembly is packaged and transferred with the sub-assembly of the bolt 40 coupled as a separate unit. At different places, the following steps are taken:

(7) The male connector 10 and the female connector 60 are fitted together;

(8) The bolt 40 is inserted into the bolt mounting hole 22 of the bolt holder 20. In this process, the engaging pieces **44*b*, 44*c* of the stop ring 44 are advanced while being pressed by the peripheral surface of the smaller-diameter portion 22*c* of the bolt holder 20, so that the washer 42 comes into contact with the bulkhead 11*a*. As a result, the bolt 40 is restricted in its movement toward the insertion direction and besides the engaging pieces 44*b*, 44*c* are engaged with the step portion 22*b* of the bolt holder 20. Thus, the bolt 40 is rotatably mounted to the bolt holder 20, where the tip of the bolt 40 is in contact with the nut 66 of the female connector 60; and (9) Turning the bolt 40 clockwise causes its male screw portion 41 to be screwed to the female screw portion 66*a* of the nut 66. Further turning the bolt 40 clockwise causes the larger-diameter shaft portion 47 of the bolt 40 to press the housing 11 via the bolt holder 20, so that the housing 11 moves toward such a direction that the male connector 10 and the female connector 60** are mated with each other.

In addition, in order to demate the connectors 10, 60 from each other, turning the bolt 40 counterclockwise causes the engaging pieces **44*b*, 44*c* of the stop ring 44 to press the housing 11 via the bolt holder 20, so that the housing 11 moves toward such a direction that the connectors 10, 60** are demated from each other.

As shown above, according to the present embodiment, connecting terminals are accommodated in the male connector 10 without mounting the bolt holder 20, the grommet 30, or the wire cover 32. These members can be mounted after the connecting terminals have been accommodated. Also, since the bolt 40 is mounted to the bolt holder 20 after the male connector 10 and the female connector 60 have been fitted to each other, the male connector 10 and the female connector 60 can be packaged and transported, before their mating, without mounting the bolt 40. This allows the end face of the male connector 10 to be maintained flat during the packaging, transfer, assembly, and other processes of the wire harness equipped with the male connector 10. Accordingly, the insertion work with the connecting terminals for inserting the connecting terminals into the terminal holes 17 can be easily automatized, and besides, the bolt 40 can be prevented from damaging the wire harness and flawing the car body.

Further, since the male connector 10 is not normally provided with the bolt 40, the weight of the wire harness can be reduced so that the working efficiency of the packaging, transferring, rigging, and other processes of the wire harness can be enhanced. Also since the bolt 40 can be handled singly and separately, the bolt 40 can be easily protected against rust, so that the quality of the bolt 40 can be successfully maintained.

Meanwhile, since the grommet holder body 51 of the grommet holder 50 surrounds front part of the fit portion 33 of the grommet 30, the fit portion 33 can be prevented from outside flaws. Besides, even if the grommet 30 is bent or compressed successively, the fit portion 33 of the grommet 30 can be prevented from being expanded wider by its internal pressure, so that the mating of the grommet 30 and the housing 11 can be maintained securely. Furthermore, since the grommet holder body 51 cannot be fitted to the grommet 30 unless the grommet 30 is fitted to the housing 11 in proper position, it can be verified whether the grommet 30 has been fitted to the housing 11 in proper position. Thus, incomplete mating between the grommet 30 and the housing 11 can be prevented.

As described above, the bolt-equipped connector according to the present invention is so arranged that a tubular bolt holder is initially inserted and fitted into the connector body, and that the bolt is mounted to the bolt holder at the time of mating with the counter connector. Therefore, until the connector body is coupled with the counter connector, the end face of the connector body can be maintained flat. As a result, the insertion work of inserting the connecting terminals can be easily automatized, while the other members can be prevented from damage.

Furthermore, if a grommet fixing member is fitted to the grommet fitted to the connector body, then the grommet can be prevented from being damaged from external and being expanded in diameter. Thus, the grommet can be fixed to the connector body with reliability.

What is claimed is:

1. A bolt-equipped electrical connector comprising a connector body which accommodates connecting terminals with a wire harness connected thereto and which is to be mated with a counter connector, and a bolt which is to be mounted to the connector body and which has at its tip a screw portion to be screwed to the counter connector, wherein the bolt is mounted via a tubular bolt holder engaged with the connector body, the bolt holder comprises a holder body to be fitted to a bolt mounting hole of the connector body, a bolt insertion hole provided inside the holder body and serving for inserting the bolt there through, a claw portion which is provided on outer periphery of the holder body and which is to be engaged with the engaging portion of the connector body, a stop ring which permits the bolt to turn and which restricts forward and backward movement of the bolt is mounted to the bolt, and the stop ring is engaged with a peripheral wall of the bolt insertion hole of the bolt holder.

2. The bolt-equipped electrical connector according to claim 1, wherein the bolt insertion hole of the bolt holder comprises a larger-diameter portion at a deep portion, and the stop ring has an engaging piece to be engaged with a step portion of the large-diameter portion.

3. A bolt-equipped electrical connector comprising a connector body for mating with a counter connector and for holding a wire harness having connecting terminals for each wire of the wire harness; the connector body having a bolt mounting hole, a guide recess, and an engaging portion; a tubular bolt holder having a bolt body received in the bolt mounting hole, a bolt insertion hole and a flexible arm for sliding in the guide recess of the connector body; a bolt passing through the bolt insertion hole of the tubular bolt holder, the bolt having a tip with a screw portion for screwing the connector body to the counter connector, the flexible arm of the tubular bolt holder having a claw, wherein the tubular bolt holder is secured in the connector body by sliding the flexible arm in the guide recess and flexing the flexible arm inward until the claw engages the engaging portion of connector body.

4. The bolt-equipped connector according to claim 3, wherein a seal member is interposed between peripheral wall surface of the holder mounting hole of the connector body and the outer peripheral surface of the holder body.

5. The bolt-equipped electrical connector according to claim 3, wherein outside diameter of a base portion of the bolt and inside diameter of the bolt insertion hole are approximately equal to each other.

6. A bolt-equipped electrical connector comprising a connector body for mating with a counter connector and for holding a wire harness having connecting terminals, a bolt mounted within the connector body, a grommet for protecting the wire harness and fitted to the connector body, and a grommet holder for fixing the grommet to the connector body, said bolt having a tip with a screw portion for screwing the connector body to the counter connector, the connector body including a flange; the grommet including an outer periphery with an engaging protrusion, a face end portion, an engaging projection, an annular recess for fitting the flange of the connector body and an insertion hole for inserting the bolt therethrough; the grommet holder having a frame body fitting over the outer periphery of the grommet, a frame holder portion having a diameter smaller than an inner diameter of the frame body and contacting the end face portion of the grommet, an engaging portion protruding inwardly from a rear part of the frame body and fitted over the engaging protrusion of the grommet, and an engaging hole receiving the engaging projection of the grommet; whereby the grommet holder securely couples the connector body in place when the grommet holder and the engaging protrusion of the grommet holder are respectively fitted over the outer periphery and the engaging protrusion of the grommet and the engaging projection of the grommet is received in the engaging hole of the grommet holder.

* * * * *